US005477717A

United States Patent [19]

Skrebergene et al.

[11] Patent Number: 5,477,717

[45] Date of Patent: Dec. 26, 1995

[54] APPARATUS FOR CUTTING HELICALLY WOUND METAL TUBING

[75] Inventors: Nils O. Skrebergene; Paul H. Brudeli, both of Gjövik, Norway

[73] Assignee: Spiro Machines S.A., Boesingen, Switzerland

[21] Appl. No.: 146,032

[22] PCT Filed: Mar. 3, 1993

[86] PCT No.: PCT/GB93/00438

§ 371 Date: Nov. 4, 1993

§ 102(e) Date: Nov. 4, 1993

[87] PCT Pub. No.: WO93/17803

PCT Pub. Date: Sep. 16, 1993

[30] Foreign Application Priority Data

Mar. 6, 1992 [GB] United Kingdom ..... 9204917

[51] Int. Cl.[6] ..... B21C 37/12

[52] U.S. Cl. ..... 72/49; 72/132; 83/184; 83/185

[58] Field of Search ..... 72/49, 50, 129, 72/131, 132, 133, 135, 137; 82/53.1, 58, 79, 82, 88, 92, 93; 83/184, 185, 318, 320, 321

[56] References Cited

U.S. PATENT DOCUMENTS

| | | | |
|---|---|---|---|
| 957,966 | 5/1910 | Jenkins . | |
| 3,132,616 | 5/1964 | Hale et al. . | |
| 4,054,069 | 10/1977 | Coop | 82/57 |
| 4,706,481 | 11/1987 | Castricum | 72/49 |
| 4,823,579 | 5/1989 | Castricum | 72/49 |
| 5,020,351 | 6/1991 | Castricum | 72/49 |
| 5,193,374 | 3/1993 | Castricum | 72/132 |

FOREIGN PATENT DOCUMENTS

| | | | |
|---|---|---|---|
| 0206201A2 | 12/1986 | European Pat. Off. . | |
| 0403425A1 | 12/1990 | European Pat. Off. . | |
| 2843372 | 4/1980 | Germany | 83/185 |

*Primary Examiner*—Lowell A. Larson
*Assistant Examiner*—Thomas C. Schoeffler
*Attorney, Agent, or Firm*—Spencer, Frank & Schneider

[57] ABSTRACT

A cutting apparatus usable in a machine having a forming head for helically winding a metal strip into a helically wound metal tubing and for issuing the helically wound metal tubing along a defined path. The apparatus includes a first mounting for supporting the forming head, and a carriage guided and longitudinally movable along the first mounting in a direction of travel parallel to the defined path. A cantilever boom has one end mounted to a first end of the carriage and a free end opposite to the one end. The boom extends generally parallel to the direction of travel. A cutting blade is connected to the free end of the cantilever boom and extends in a plane generally perpendicular to the direction of travel. A second mounting is guided with the carriage and is extendible in a direction generally perpendicular to the direction of travel. A rotary shaft is carried by the second mounting. A cutting wheel is mounted to the rotary shaft and extends in the plane generally perpendicular to the direction of travel to cooperate with the cutting blade. The cutting wheel is movable both toward and away from the cutting blade to penetrate a wall of the helically wound metal tubing interposed therebetween. A driving motor with a drive shaft is mounted on a second end of the carriage. A universally jointed transmission shaft couples the rotary shaft to the drive shaft of the driving motor and allows for the extending of the second mounting.

8 Claims, 4 Drawing Sheets

APPARATUS FOR CUTTING HELICALLY WOUND METAL TUBING

BACKGROUND OF THE INVENTION

This invention concerns an apparatus for cutting helically wound metal tubing, and relates more especially to a cutting apparatus that can be installed within a machine for producing helically wound metal tubing to enable lengths of tubing to be severed as the tubing issues from the machine.

It is known to sever lengths of helically wound tubing as it issues from a machine by cutting means that is adapted to travel longitudinally with the moving tubing, in order to cut the tubing in a transverse plane. Such devices are known, for example, from U.S. Pat. Nos. 957,966, 3,132,616 and 4,706,481.

In order to cut metal tubing of relatively light gauge metal sheet, for example of the kind formed from a helically wound strip, there can be used either a rotary slitting saw, or a pair of cooperating slitting wheels operating from the inside and outside of the pipe, one of the wheels being forced through the wall of the pipe to overlap the other so that the wall of the pipe is cut in a shearing action. Such a mechanism has now become commonplace in the domestic can-opener. A mechanism of this kind adapted for the cutting of the wall of a metal tube is known from U.S. Pat. No. 4,054,069 and comprises cutting rollers, one of which is mounted for rotation on a boom arranged to extend within the hollow pipe, and the other of which is mounted externally of the pipe and guided for movement in a direction normal to the wall of the pipe in order to penetrate the latter and overlap the internal cutting roller.

Although such cooperating slitting wheels are normally driven to rotate when cutting, the application of such a cutting mechanism to a machine for the helical winding of metal tubing involves the difficulty that the association of the cutting wheels with a carriage arranged to travel relatively to the forming head of the machine cannot easily be achieved whilst maintaining a drive transmission to the shafts upon which the cutting wheels are mounted.

Thus, for example, as described in U.S. Pat. No. 4,706,481 it is proposed to dispense with any mechanism for driving the cutting wheels, and to leave them to rotate idly in contact with the metal tubing that rotates as it issues from the machine. Whilst such an arrangement has proved effective for cutting metal tubing having a relatively low wall thickness, it does have the disadvantage that additional stresses are placed upon the main drive of the machine that is required to advance the metal strip through the helical forming head, since the driving rollers contacting the metal strip are now required not only to drive the strip around the helical path defined by the forming head, but also to overcome the resistance to rotation of the tube due to the cutting mechanism.

SUMMARY OF THE INVENTION

It is accordingly an object of the present invention to overcome or at least reduce the above-mentioned disadvantage.

In accordance with the invention there is provided a cutting apparatus for incorporation in a machine for the formation of helically wound metal tubing, comprising a mounting for supporting a forming head to which metal strip is to be advanced for winding helically into a tube, a carriage guided for longitudinal travelling movement along an axis intended to be parallel to the axis of tubing issuing from the forming head, a cantilever boom mounted to the carriage at one end, extending generally parallel to the axis of travel of the carriage and having at its free end a cutting blade extending in a plane generally normal to the axis, an extendible mounting guided on the carriage for movement in a direction normal to the axis and carrying a rotary shaft on which is mounted a cutting wheel arranged to cooperate with the cutting blade and likewise extending in a plane normal to the axis, and a driving motor mounted upon the carriage at a point remote from the mounting of the boom and laterally spaced from the path of tubing away from the forming head, a drive shaft of the motor being coupled to the shaft bearing the rotary cutting wheel by means of a universally jointed transmission shaft permitting extension of the mounting, whereby the cutting wheel can be moved towards and away from the cutting blade between a position spaced from the blade and a position in which it overlaps the blade in order to penetrate the wall of a metal tube interposed therebetween.

The arrangement according to the invention enables a driving motor to be coupled to the shaft of the rotary external cutting wheel without impeding the movement thereof and without obstructing the path of tubing from the forming machine. Rotary action of the shaft of the cutting wheel enables load on the main drive of the tube forming machine to be reduced, and the drive to the cutting wheel shaft is conveniently located away from the forming head so that there is no intrusion on space required for operational elements of the tube forming machine.

The cutting blade provided at the free end of the cantilever boom may be a fixed blade, or may be a cutting wheel mounted for passive rotation.

In accordance with a preferred feature of the invention the external cutting wheel may be arranged to undergo orbital motion so that it oscillates in a direction towards and away from the axis of the tubing while remaining in overlapping relationship with the cooperating cutting blade. This provides a more effective shearing action in some applications, for example in cutting tubing of heavier gauge. Thus the shaft bearing of the cutting wheel may comprise a journal portion carried in a bearing of the extendible mounting and an eccentric crank portion on which the cutting wheel is mounted. When the cutting wheel is required to oscillate at high speed to produce a shearing action the orbital speed of the eccentric shaft will be greater than the corresponding circumferential speed of the tubing to be cut, in which case the cutting wheel is mounted to be freely rotatable on the crank portion of its shaft. Although the cutting wheel is not then positively driven by the shaft on which it is carried, the action of the driven eccentric crank portion will still be effective to reduce the load on the main drive of the tube forming machine, provided that the orbital motion is in the same direction as that of the motion of the tubing.

BRIEF DESCRIPTION OF THE DRAWINGS

Further preferred features and advantages of the invention will become apparent from the following description taken in conjunction with the accompanying drawings, in which.

DETAILED DESCRIPTION OF THE DRAWINGS

Figure 1:
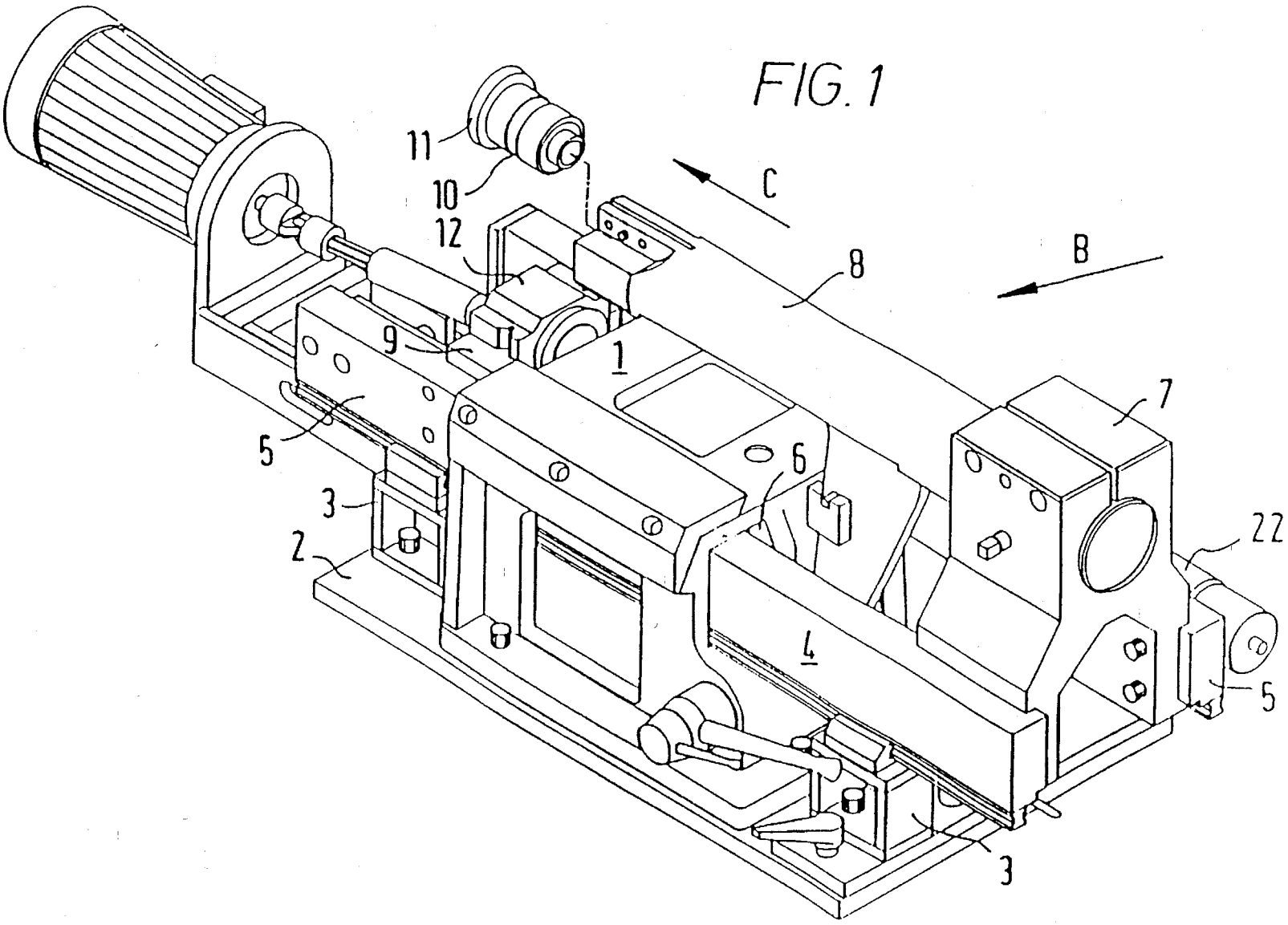
FIG. 1 is a perspective view of an apparatus in accordance with the invention for use in cutting helically wound metal tubes.
Figure 2:
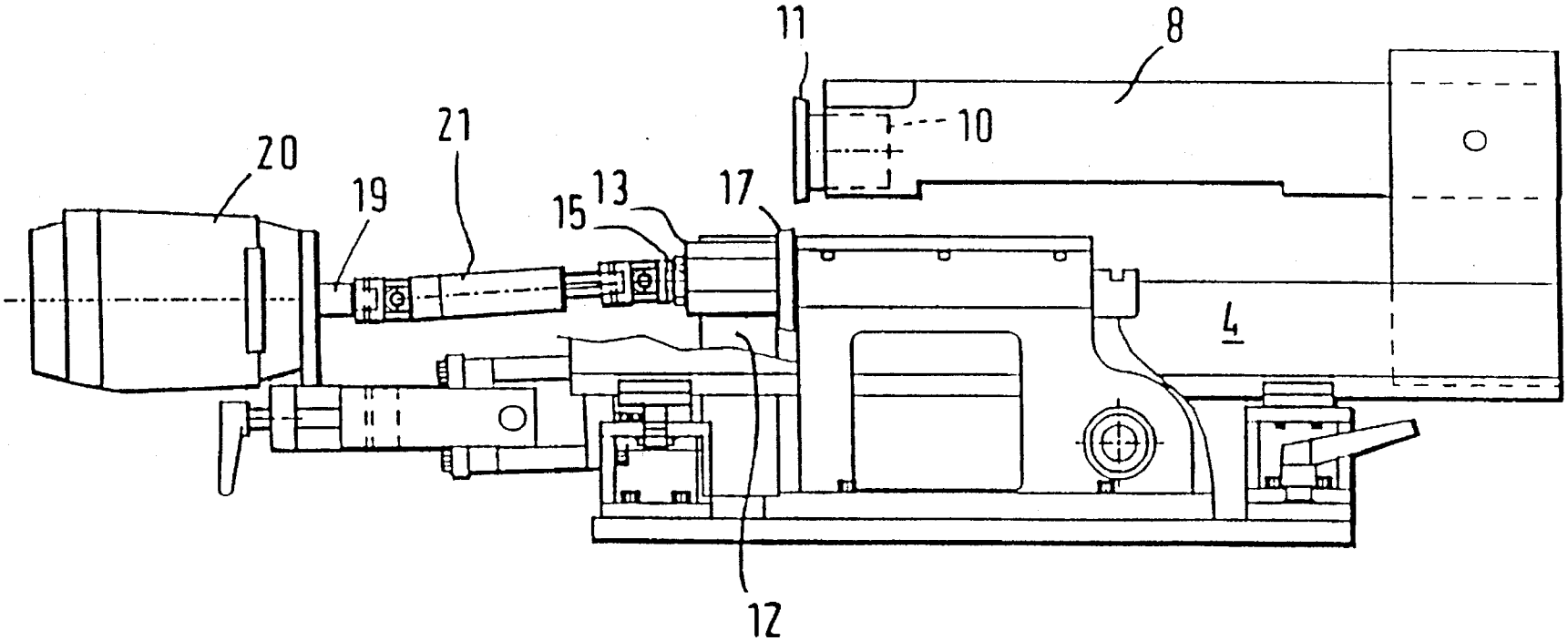
FIG. 2 is a side elevation of an apparatus as illustrated in FIG. 1.

Referring to FIGS. 1 and 2 of the drawings, a cutting apparatus in accordance with the invention comprises a main frame 1 providing a mounting for the forming head of a machine for forming helically wound metal tubing, for example so-called lock seam tubing. The elements of the tube forming machine are omitted from the drawing for clarity, but are of well known construction which will be familiar to one skilled in the art.

The main frame 1 comprises a base 2 upon which are located mountings 3 receiving a longitudinally slidable carriage 4. The carriage 4 is guided for longitudinal movement on the mountings 3 by precision anti-friction bearings of a type known for use in the carriages of machine tools and comprises a pair of slide members 5 that pass through apertures 6 in the main frame 1. The slide members 5 are coupled together at one end by a pillar 7 that carries a cantilever boom 8 extending parallel to the slide axis of the members 5 and are coupled together at the other end by a mounting 9 to be described below.

The boom 8 has at its free end a cylindrical recess, not illustrated, within which is clamped a mounting block 10, shown in exploded view in FIG. 1, carrying a passively rotatable cutting wheel 11 extending in a plane normal to the axis of the boom 8.

Figure 4:
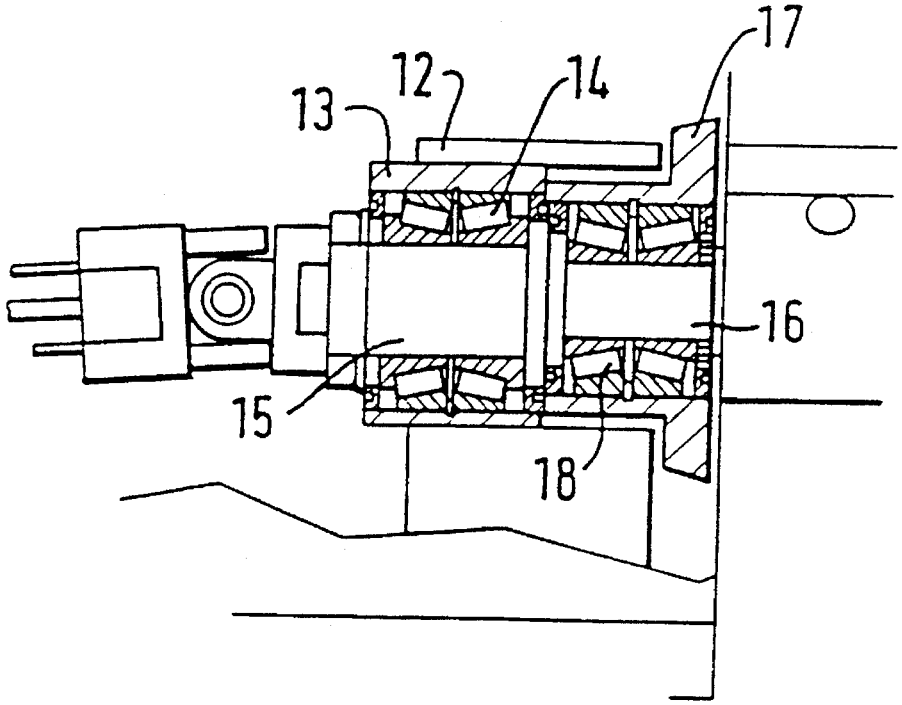
FIGS. 4 and 5 are fragmentary sectional views of alternative details of the apparatus of FIGS. 1 to 3.

As shown more clearly in FIG. 4, the mounting 9 incorporates a pillar 12 carrying a hollow bush 13 within which is located a roller bearing 14. The bearing 14 in turn carries a rotary shaft 15 having an eccentric crank pin 16 on which is carried a rotatable cutting wheel 17 via a further roller bearing 18.

The pillar 12 is upwardly extendable from the position shown in FIG. 2 to a position in which the cutting wheel 17 overlaps the cutting blade 11, for example by means of a fluid pressure operated ram and toggle mechanism coupled to the mounting 9.

The shaft 15 is coupled to the drive shaft 19 of a motor 20 mounted to the left hand end of the carriage 4 as viewed in FIG. 2, via a Cardan shaft 21 permitting vertical displacement of the shaft 15.

The carriage 4 is coupled to the main frame 1, via one of the slide members 5, by a servo mechanism 22 (FIG. 1) by means of which it can be driven longitudinally relatively to the frame 1.

Figure 3:
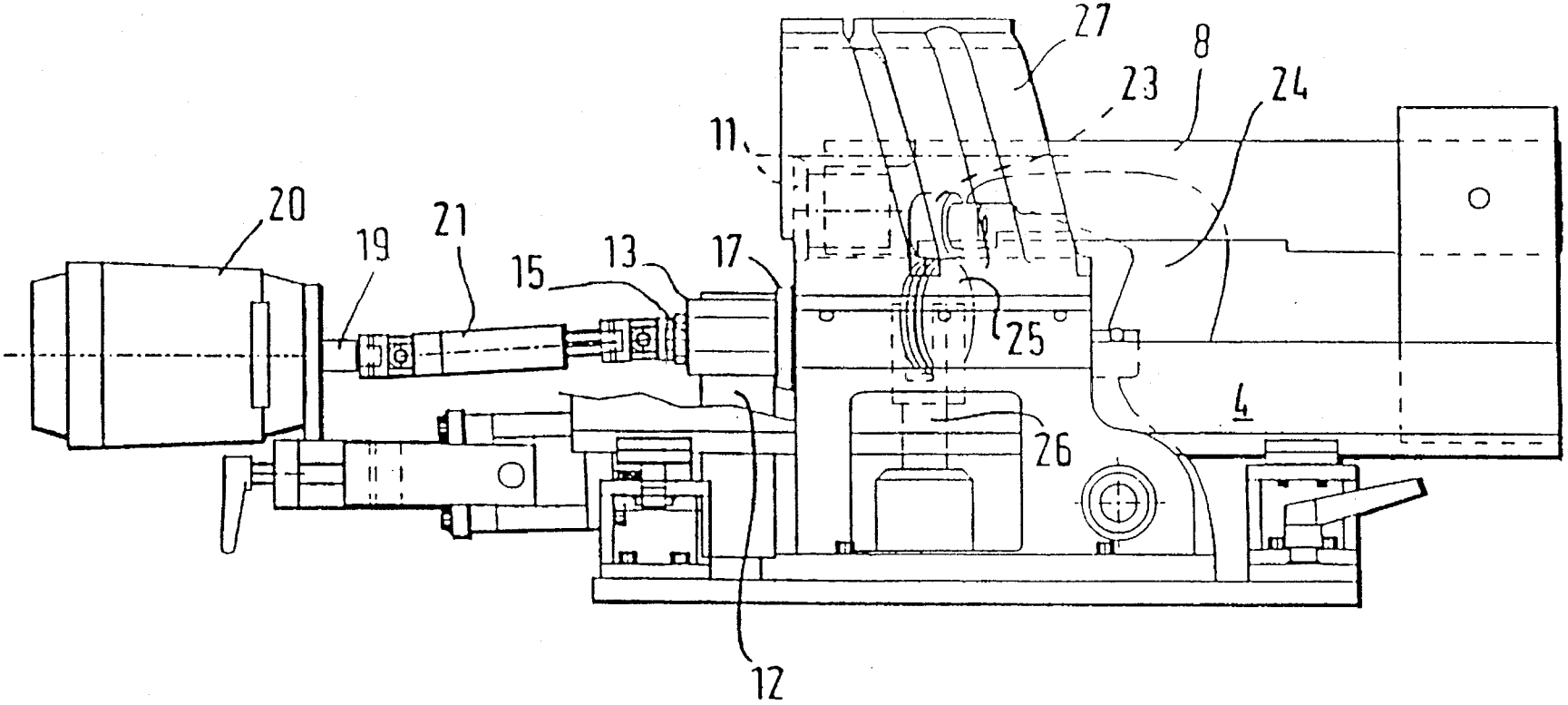
FIG. 3 is a view similar to FIG. 2 showing the apparatus of the invention in conjunction with a tube forming machine.

The operation of the apparatus will now be described in more detail, but firstly the relationship between the apparatus and a lock seam tube forming machine should be noted with reference to FIG. 3, in which the reference numeral 27 indicates the conventional helical forming head of the machine, 23 is an upper clinching roller carried by a bracket 24 passing through a hollow in the boom 8, and 25 is a lower clinching roller carried in a vertically movable ram 26 mounted to the base 1.

As will be well understood by one skilled in the art of lock seam tube forming machines, metal strip is fed to the forming head 27 along an oblique axis indicated by the arrow B in FIG. 1, and, after formation of the tubing in the head 27 it leaves the machine along a longitudinal axis indicated by the arrow C in FIG. 1, to be taken up on a receiving table, not illustrated, located beyond the motor 20.

During normal operation of the tube forming machine, the carriage 4 is located in its right hand end position as illustrated in FIG. 1 and the pillar 12 is lowered so that the wall of the formed tubing can pass between the cutting blade 11 and the cutting wheel 17. When it is desired to sever a length of formed tubing, which may be measured by determining the length of a section of metal strip that has been fed to the machine, the main drive of the machine is stopped, the pillar 12 is extended upwards to force the cutting wheel 17 through the wall of the tubing until it overlaps the blade 11, and then the main drive of the machine is restarted to drive the tubing to rotate relatively to the cutters. At the same time, the driving motor 20 is switched on and the servo mechanism 22 is actuated to cause the carriage 4 to traverse to the left as viewed in FIG. 2 in synchronism with the movement of the tubing. If necessary the main drive of the machine is operated at a slower rate than during the normal production of the tubing. When the tubing has completed a full rotation and a section is severed by the cutters, the pillar 12 is lowered, the carriage 4 is returned to its right hand end position, the motor 20 is switched off and the normal operation of the tube forming machine is restored. As will be appreciated by one skilled in the art the relative timing of these actions can readily be controlled automatically by an appropriate microprocessor system.

Whilst one embodiment of the invention has been described by way of example, it will be appreciated that various alterations and modifications may be made to the arrangement as described and illustrated without departing from the scope of the invention.

Figure 5:
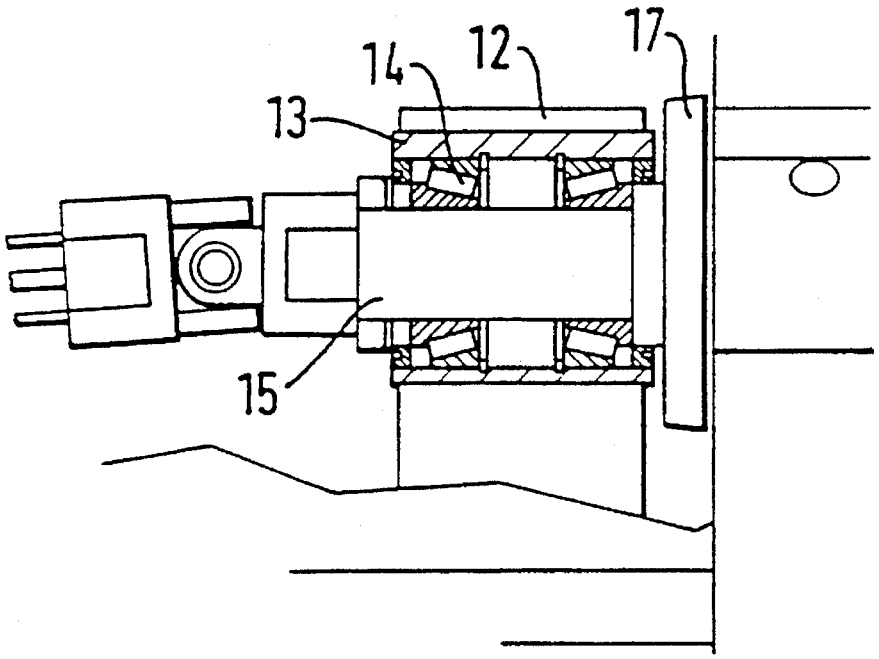

Thus, where an orbital shearing action is unnecessary, for example when cutting lighter gauge metal, the cutting wheel 17 may be fixed directly to the shaft 15, the crank 16 and the bearing 18 being omitted, as shown in FIG. 5.

Although the carriage 4 is driven by the servo mechanism 22 it would also be possible for the carriage to be advanced passively by pressure of the tubing on the cutting wheel 17, provided that means is provided to return the carriage to its starting position at the end of a cutting operation.

We claim:

1. A cutting apparatus usable in a machine having a forming head for helically winding a metal strip into a helically wound metal tubing and for issuing the helically wound metal tubing along a defined path, comprising:

a first mounting for supporting the forming head;

a carriage guided and longitudinally movable along said first mounting in a direction of travel parallel to the defined path;

a cantilever boom having one end mounted to a first end of said carriage and having a free end opposite to the one end, said cantilever boom extending generally parallel to the direction of travel;

a cutting blade connected to the free end of said cantilever boom and extending in a plane generally perpendicular to the direction of travel;

a second mounting guided with said carriage and being extendible in a direction generally perpendicular to the direction of travel;

a rotary shaft carried by said second mounting;

a cutting wheel mounted to said rotary shaft and extending in the plane generally perpendicular to the direction of travel to cooperate with said cutting blade, said cutting wheel being movable both toward and away from said cutting blade between a first position wherein said cutting blade is spaced from said cutting wheel, and a second position wherein said cutting blade overlaps said cutting wheel to penetrate a wall of the helically wound metal tubing interposed therebetween;

a driving motor mounted on a second end of said carriage opposite to the first end and being laterally spaced from the defined path, said driving motor having a drive shaft; and a universally jointed transmission shaft coupling said rotary shaft to the drive shaft of said driving motor and allowing for the extending of said second mounting.

2. A cutting apparatus as defined in claim 1, wherein said cutting blade comprises an additional cutting wheel mounted to be passively rotatable.

3. A cutting apparatus as defined in claim 1, wherein said cutting wheel is mounted to orbitally rotate so as to oscillate in a direction toward and away from the defined path while maintaining an overlapping relationship with said cutting blade when said cutting wheel is in the second position.

4. A cutting apparatus as defined in claim 3, wherein said rotary shaft has an eccentric crank portion having said cutting wheel mounted thereon.

5. A cutting apparatus as defined in claim 4, wherein said cutting wheel is mounted on said eccentric crank portion to be freely rotatable.

6. An apparatus for forming and cutting a helically wound metal tubing, comprising:

a machine having a helical forming head for helically winding a metal strip into a helically wound metal tubing and for issuing the helically wound metal tubing along a defined path;

means for advancing the metal strip through said helical forming head; and a cutting apparatus, comprising:

a first mounting for supporting the helical forming head;

a carriage guided and longitudinally movable along said first mounting in a direction of travel parallel to the defined path;

a cantilever boom extending through said helical forming head and having one end mounted to a first end of said carriage and having a free end opposite to the one end, said cantilever boom extending generally parallel to the direction of travel; and a cutting blade connected to the free end of said cantilever boom and extending in a plane generally perpendicular to the direction of travel;

a second mounting guided with said carriage and being extendible in a direction generally perpendicular to the direction of travel;

a rotary shaft carried by said second mounting;

a cutting wheel mounted to said rotary shaft and extending in the plane generally perpendicular to the direction of travel to cooperate with said cutting blade, said cutting wheel being movable both toward and away from said cutting blade between a first position wherein said cutting blade is spaced from said cutting wheel, and a second position wherein said cutting blade overlaps said cutting wheel to penetrate a wall of the helically wound metal tubing interposed therebetween;

a driving motor mounted on a second end of said carriage opposite to the first end and being laterally spaced from the defined path, said driving motor having a drive shaft; and a universally jointed transmission shaft coupling said rotary shaft to the drive shaft of said driving motor and allowing for the extending of said second mounting.

7. An apparatus as defined in claim 6, wherein said means advances the metal strip around said helical forming head at a predetermined first peripheral speed, and said rotary shaft has an eccentric crank portion having said cutting wheel mounted thereon, said cutting wheel being rotatable at a second peripheral speed greater than the first peripheral speed.

8. An apparatus as defined in claim 7, wherein said cutting wheel is oscillatable in a direction towards and away from the defined path.

* * * * *